US009415582B2

(12) United States Patent
Drury et al.

(10) Patent No.: US 9,415,582 B2
(45) **Date of Patent: *Aug. 16, 2016**

(54) DROPLET DEPOSITION APPARATUS

(71) Applicant: XAAR TECHNOLOGY LIMITED, Cambridgeshire (GB)

(72) Inventors: Paul Raymond Drury, Royston (GB); Angus Condie, Cambridge (GB); Jerzy M. Zaba, Cambridge (GB)

(73) Assignee: XAAR TECHNOLOGY LIMITED, Cambridgeshire (GB)

( * ) Notice: Subject to any disclaimer, the term of this patent is extended or adjusted under 35 U.S.C. 154(b) by 196 days.

This patent is subject to a terminal disclaimer.

(21) Appl. No.: 14/297,284

(22) Filed: Jun. 5, 2014

(65) Prior Publication Data

US 2014/0285581 A1 Sep. 25, 2014

Related U.S. Application Data

(60) Continuation of application No. 12/683,809, filed on Jan. 7, 2010, now Pat. No. 8,783,583, which is a division of application No. 10/168,668, filed as application No. PCT/GB01/00050 on Jan. 5, 2001, now Pat. No. 7,651,037.

(30) Foreign Application Priority Data

Jan. 7, 2000 (GB) ..... 0000368.1

(51) Int. Cl.
*B05B 17/06* (2006.01)
*B41J 2/045* (2006.01)
(Continued)

(52) U.S. Cl.
CPC ..... *B41J 2/04501* (2013.01); *B05B 17/0646* (2013.01); *B41J 2/14209* (2013.01); *B41J 2002/14491* (2013.01); *B41J 2202/12* (2013.01); *B41J 2202/20* (2013.01)

(58) Field of Classification Search
CPC B05B 17/06; B05B 17/0607; B05B 17/0638; B05B 17/0653; B05B 17/0676; B05B 17/0646; B41J 2/01; B41J 2/015; B41J 2/04; B41J 2/045; B41J 2/04501; B41J 2/135; B41J 2/14; B41J 2/14201; B41J 2/14209; B41J 2002/14491; B41J 2202/01; B41J 2202/12; B41J 2202/20
USPC ..... 239/132–132.5, 102.1, 102.2, 124, 125, 239/129, 133–135, 550, 551, 557, 562, 563, 239/564, 566
See application file for complete search history.

(56) References Cited

U.S. PATENT DOCUMENTS 4,062,492 A 12/1977 Thornton
4,605,167 A 8/1986 Maehara
(Continued)

FOREIGN PATENT DOCUMENTS

DE 197 43 804 A1 4/1999
EP 0 277 703 A1 8/1988
(Continued)

OTHER PUBLICATIONS

International Search Report for Application No. PCT/GB01/00050, dated Aug. 20, 2001.
(Continued)

*Primary Examiner* — Christopher Kim
(74) *Attorney, Agent, or Firm* — Marshall, Gerstein & Borun LLP

(57) ABSTRACT

Droplet deposition apparatus including at least one droplet ejection unit having a plurality of fluid channels disposed side by side in a row, an actuator, and a plurality of nozzles, said actuator being actuable to eject a droplet of fluid from a fluid channel through a respective nozzle, a support member for said at least one droplet ejection unit, a first conduit extending along said row and to one side of both said support member and said at least one droplet ejection unit for conveying droplet fluid to each of the fluid channels of said at least one droplet ejection unit; and a second conduit extending along said row and to the other side of both said support member and said at least one droplet ejection unit for receiving droplet fluid from each of the fluid channels of said at least one droplet ejection unit.

20 Claims, 13 Drawing Sheets

(51) Int. Cl.
*B41J 2/14* (2006.01)
*B05B 17/00* (2006.01)

(56) References Cited

U.S. PATENT DOCUMENTS

| | | | | |
|---|---|---|---|---|
| 5,010,356 | A | 4/1991 | Albinson | |
| 5,801,733 | A | 9/1998 | Pankert | |
| 5,833,811 | A | 11/1998 | Ando et al. | |
| 5,906,481 | A | 5/1999 | Ogawa et al. | |
| 5,992,963 | A | 11/1999 | Miyake et al. | |
| 6,070,965 | A | 6/2000 | Fujimoto | |
| 6,281,914 | B1 | 8/2001 | Hiwada et al. | |
| 7,651,037 | B2 | 1/2010 | Drury et al. | |
| 8,783,583 | B2 * | 7/2014 | Drury | B41J 2/14209 239/102.2 |
| 2003/0150931 | A1 | 8/2003 | Drury et al. | |
| 2010/0110136 | A1 | 5/2010 | Drury et al. | |

FOREIGN PATENT DOCUMENTS

| | | | |
|---|---|---|---|
| EP | 0 278 590 | A1 | 8/1988 |
| EP | 0 367 438 | A1 | 5/1990 |
| EP | 0 505 188 | A2 | 9/1992 |
| EP | 0 595 654 | A2 | 5/1994 |
| EP | 0 813 969 | A2 | 12/1997 |
| EP | 0 931 650 | A1 | 7/1999 |
| EP | 1 013 432 | A2 | 6/2000 |
| JP | 05-147215 | A | 6/1993 |
| JP | 08-072249 | A | 3/1996 |
| JP | 09-057959 | A | 3/1997 |
| JP | 09-094970 | A | 4/1997 |
| JP | 10-114081 | A | 5/1998 |
| JP | 10-146974 | A | 6/1998 |
| JP | 10-193596 | A | 7/1998 |
| JP | 10-217455 | A | 8/1998 |
| JP | 10-264390 | A | 10/1998 |
| JP | 10-278283 | A | 10/1998 |
| JP | 11-034338 | A | 2/1999 |
| WO | WO-96/13388 | A1 | 5/1996 |
| WO | WO-98/52763 | A2 | 11/1998 |
| WO | WO-99/19147 | A1 | 4/1999 |
| WO | WO-99/46127 | A1 | 9/1999 |

OTHER PUBLICATIONS

International Preliminary Examination Report for Application No. PCT/GB01/00050, dated Apr. 17, 2002.

* cited by examiner

DROPLET DEPOSITION APPARATUS

CROSS-REFERENCE TO RELATED APPLICATIONS

This application is a continuation of U.S. patent application Ser. No. 12/683,809, filed Jan. 7, 2010, which is a divisional of U.S. patent application Ser. No. 10/168,668, filed Apr. 4, 2003, now issued as U.S. Pat. No. 7,651,037, which was the US national phase of International Application No. PCT/GB01/00050, filed Jan. 5, 2001. The priority applications, U.S. Ser. No. 12/1683,809, U.S. Ser. No. 10/168,668 and PCT/GB01/00050, are hereby incorporated by reference.

FIELD OF THE DISCLOSURE

The present disclosure relates to droplet deposition apparatus, such as, for example, a drop-on-demand inkjet printer.

DESCRIPTION OF THE RELATED ART

In order to increase the speed of inkjet printing, inkjet printheads are typically provided with an increasing number of ink ejection channels. For example, there are commercially available inkjet printheads having in excess of 500 ink ejection channels, and it is anticipated that in future so called "pagewide printers" could include printheads containing in excess of 2000 ink ejection channels.

SUMMARY OF THE DISCLOSURE

In at least its preferred embodiments, the present invention seeks to provide droplet deposition apparatus suitable for use in a pagewide printer and having a relatively simple and compact structure.

In a first aspect, the present invention provides droplet deposition apparatus comprising: at least one droplet ejection unit comprising a plurality of fluid channels disposed side by side in a row, actuator means, and a plurality of nozzles, said actuator means being actuable to eject a droplet of fluid from a fluid channel through a respective nozzle; a support member for said at least one droplet ejection unit; and a first conduit extending along said row and to one side of both said support member and said at least one droplet ejection unit for conveying droplet fluid to each of the fluid channels of said at least one droplet ejection unit.

Where the apparatus comprises a plurality of droplet ejection units, the first conduit is preferably configured to convey droplet fluid to each of the fluid channels of said plurality of droplet ejection units. Thus, all of the ink channels can be supplied with ink from one conduit. This can reduce significantly the number of ink supply channels or conduits required to convey ink to the ink channels, thereby simplifying machining and providing a compact droplet deposition apparatus.

Preferably, the apparatus comprises a second conduit for conveying droplet fluid away from each of the fluid channels of said at least one droplet ejection unit.

In one embodiment, there are a plurality of rows of channels, the droplet ejection units being arranged on the support member such that at least some of the fluid channels of adjacent rows of fluid channels are substantially co-axial. Thus, there may be effectively one fluid inlet and one fluid outlet for a number of coaxial ink channels. This can reduce significantly the size of the printhead in the direction of the paper feed. This can also allow the printheads to be closely stacked in the direction of paper feed, which is advantageous in achieving accurate drop placement, a compact printer and hence a lower cost.

In a preferred arrangement, each fluid channel has a length extending in a first direction and said at least one row extends in a second direction substantially orthogonal to said first direction. With such an arrangement, preferably the at least one droplet ejection unit is arranged on the support member such that there is at least one row of fluid channels extending in the second direction.

The increased density of the components of the apparatus, such as the drive circuitry, can lead to problems associated with overheating. Therefore, preferably at least one of the conduits is arranged so as to transfer a substantial part of the heat generated during droplet ejection to droplet fluid conveyed thereby.

The apparatus may include drive circuit means for supplying electrical signals to the actuator means. The drive circuit means may be in substantial thermal contact with at least one of the conduits so as to transfer a substantial part of the heat generated in the drive circuit means to the droplet fluid. Arranging the drive circuit means in such a manner can conveniently allow the ink in the printhead to serve as the sink for the heat generated in the drive circuitry.

This can substantially reduce the likelihood of overheating, whilst avoiding the problems with electrical integrity that might occur were the integrated circuit packaging containing the circuitry allowed to come into direct contact with the ink. In one arrangement the drive circuit means is mounted on the support member, the support member being in thermal contact with at least one of the conduits. In one embodiment, the support member comprises a substantially U-shaped, or H-shaped, member, the drive circuit means being mounted on at least one of the two facing sides of the arms of the U-shaped, or H shaped, member. With this arrangement, the drive circuit means can be readily physically isolated from the fluid conveyed by the conduits.

Alternatively, the drive circuit means may be mounted on the support member so as to contact droplet fluid being conveyed by at least one of the conduits.

With this arrangement it may be necessary to electrically passivate the external surfaces of the drive circuit means.

In one embodiment the apparatus comprises a coolant conveying conduit for conveying a coolant fluid, the drive circuit means being proximate the coolant conveying conduit so as to transfer a substantial part of the heat generated in the drive circuit means to the coolant fluid. Cooling of the drive circuit can thus be achieved with reduced transfer of heat to the droplet ejection units.

This can reduce any variation in droplet ejection velocity due to fluctuations in the viscosity of the fluid caused by heating of the droplet fluid by the drive circuit. The drive circuit means is preferably mounted on the support member, the support member being in thermal contact with the third conduit. Preferably, the third conduit comprises an aperture formed in the support member.

Thus, in another aspect the present invention provides droplet deposition apparatus comprising: at least one droplet ejection unit comprising a plurality of fluid channels disposed side by side in a row, actuator means, drive circuit means for supplying actuating electrical signals to said actuator means, and a plurality of nozzles, said actuator means being actuable to eject a droplet of fluid from a fluid channel through a respective nozzle; droplet fluid conveying means for conveying droplet fluid to each of the fluid channels of said at least one droplet ejection unit; and further coolant conveying means for conveying a coolant fluid, at least one of said drive circuit means and said at least one droplet ejection unit being proximate said coolant conveying means so as to transfer a substantial part of the heat generated during droplet ejection to said coolant fluid.

Preferably at least one of said at least one droplet ejection unit and said drive circuit means is mounted on said coolant conveying means. More preferably, both said at least one droplet ejection unit and said drive circuit means are mounted thereon.

Preferably, the fluid conveying means comprises a conduit extending along said row and to one side of both said coolant conveying means and said at least one droplet ejection unit for conveying droplet fluid to each of the fluid channels of said at least one droplet ejection unit. The fluid conveying means preferably also comprises a second conduit extending along said row and to the other side of both said coolant conveying means and said at least one droplet ejection unit for receiving droplet fluid from each of the fluid channels of said at least one droplet ejection unit.

In an alternative arrangement, there are two rows of fluid channels, each row being arranged on a respective support member having a respective conduit for conveying fluid to that row. Preferably, a further conduit is arranged to convey droplet fluid away from both rows of fluid channels. The second conduit preferably extends between the support members.

In one arrangement, the at least one row extends in a first direction and the channels have a length extending in a second direction substantially coplanar with and orthogonal to the first direction, the support member having a dimension in said second direction which is substantially equal to n×the length of a fluid channel in the second direction, where n is the number of rows of channels. By reducing the width of the apparatus in the direction of the paper feed, by forming the support member with a thickness substantially equal to the combined lengths of the ink channels in the second direction, improvements in paper/printhead alignment and dot registration can be provided. PZT, from which the ejection units are typically formed, is relatively expensive and so it is advantageous to ensure that a maximum number of channels are provided for a minimum amount of PZT.

Thus, in a further aspect, the present invention provides droplet deposition apparatus comprising: at least one droplet ejection unit comprising a plurality of fluid channels disposed side by side in a row extending in a first direction, said channels having a length extending in a second direction substantially coplanar with and orthogonal to said first direction, actuator means, and a plurality of nozzles, each nozzle having a nozzle axis extending in a third direction substantially orthogonal to said first and second directions, said actuator means being actuable to eject a droplet of fluid from a fluid channel through a respective nozzle; means for conveying droplet fluid to said fluid channels; and a support member for said at least one droplet ejection unit, said at least one droplet ejection unit being arranged on said support member such that there are n rows of fluid channels extending in said first direction (n being an integral number), said support member having a dimension in said second direction which is substantially equal to n×the length of a fluid channel in said second direction.

In an alternative arrangement, the support member may comprise an arm of a substantially U-shaped member, at least one droplet ejection unit being supported at the end of each of the arms of the U-shaped member.

Preferably, the second conduit extends between the arms of the U-shaped member to convey droplet fluid from the droplet ejection units supported by the arms of the U-shaped member.

With such an arrangement, the apparatus may comprise a pair of conduits each for conveying droplet fluid to the or each droplet ejection unit supported by a respective arm, each conduit extending along the external side of the respective arm of the U-shaped member.

In another arrangement, the apparatus comprises a cover member extending over and to the sides of the support member to define with the support member at least part of the conduits.

The support member and the cover member may be attached to a base which defines with the support member and the cover member the conduits. Thus, the number of apparatus components may be reduced, since, for example, the base, cover member and support member perform multiple functions (including the definition of conduits).

In yet another aspect the present invention provides droplet deposition apparatus comprising: a support member; at least one droplet ejection unit attached to said support member and comprising a plurality of fluid channels disposed side by side in a row; and a cover member extending over and to the sides of said support member to define with said support member a first conduit extending along said row for conveying fluid to said fluid channels and a second conduit extending along said row for conveying fluid from said fluid channels.

The or each droplet ejection unit may comprise actuator means and a plurality of nozzles, the actuator means being actuable to eject a droplet of fluid from a fluid channel through a respective nozzle.

The cover may include apertures for enabling droplets to be ejected from the fluid channels. These apertures are preferably etched in the cover member.

In one arrangement the nozzles are formed in the cover. In another arrangement the nozzles are formed in a nozzle plate supported by the cover, each fluid channel being in fluid communication with a respective nozzle via a respective aperture. The use of both a cover member and nozzle plate can provided enhanced tolerance for the laser ablation of the nozzles in the nozzle plate, as precise positioning of the nozzle relative to the ink chamber can become less critical. As the nozzle plate is supported by the cover, it can be made thinner, thereby reducing costs. The cover is preferably formed from a material having a coefficient of thermal expansion which is substantially equal to that of the support member.

The cover is preferably formed from metallic material, for example, from molybdenum or Nilo (a nickel/iron alloy).

The or each droplet ejection unit may comprise a first piezoelectric layer poled in a first poling direction, and a second piezoelectric layer on said first piezoelectric layer and poled in a direction opposite to said first poling direction, said fluid channels being formed in said first and second piezoelectric layers. Thus, the walls of the fluid channels can serve as wall actuators of the so called "chevron" type. These actuators are known to be advantageous because they require a lower actuating voltage to establish the same pressure in the fluid channels during operation than comparable shear mode cantilever type actuators or other conventional piezoelectric drop on demand actuators.

The first piezoelectric layer may be attached directly to said support member.

This simple arrangement of the ejection unit can enable the channels to be machined in the first and second piezoelectric layers when the layers are in situ on the support member, thereby simplifying production. In this arrangement, the support member is preferably formed from ceramic material.

In alternative arrangement, the first piezoelectric layer is formed on a base layer formed from ceramic material, said base layer being attached to said support member.

The axes of the nozzles may extend in a direction substantially orthogonal to the direction of extension of said at least one row. In other words, the droplet ejection unit may be an "edge shooter", with droplets being ejected from the top of the ink channel.

BRIEF DESCRIPTION OF THE SEVERAL VIEWS OF THE DRAWING

The invention is further illustrated, by way of example, with reference to the accompanying drawings, in which.

DETAILED DESCRIPTION OF THE PREFERRED EMBODIMENTS

The present invention relates to droplet deposition apparatus, such as, for example, drop-on-demand inkjet printheads. In the preferred embodiments of the present invention to be described below, the printhead employs a modular layout of droplet ejection modules to provide a pagewide array of droplet ejection nozzles for the ejection of fluid on to a substrate. The manufacture of such a droplet ejection module will first be described.

Figure 1:
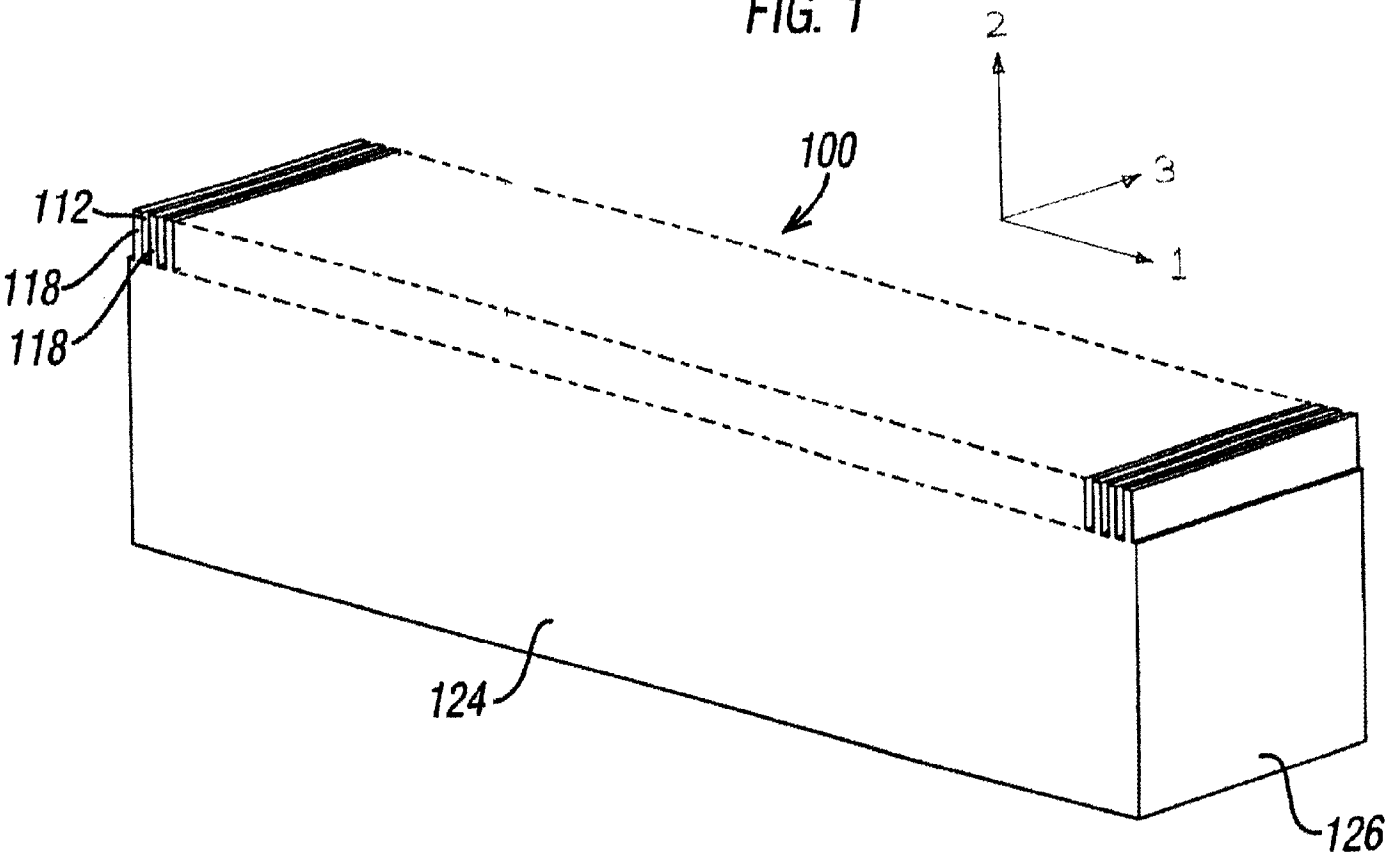
FIG. 1 represents a perspective view of a module of a droplet ejection unit.
Figure 2:
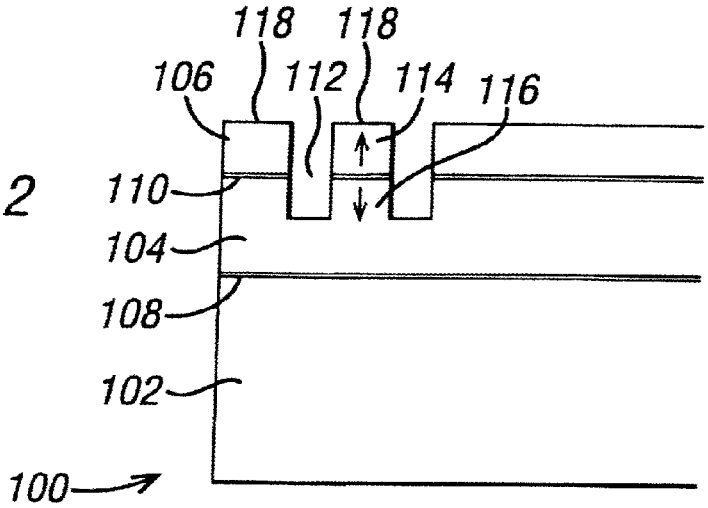
FIG. 2 represents a side view of the module shown in FIG. 1.

With reference first to FIGS. 1 and 2, a droplet ejection module 100 comprises a ceramic base wafer 102 on to which are attached first piezoelectric wafer 104 and second piezoelectric wafer 106. In the preferred embodiment, the base wafer 102 is formed from a glass ceramic wafer having a thermal expansion coefficient CTE between that of the material from which the piezoelectric layers 104,106 are formed (for example, PZT) and the material from which a support member on to which the base wafer 102 is to be attached are formed. The first piezoelectric wafer 104 is attached to the base wafer 102 by resilient glue bond material 108. Similarly, the second piezoelectric wafer 106 is attached to the first piezoelectric wafer 104 by resilient glue bond material 110. The combination of the CTE of the base wafer 102 and the resilience of the glue bond material 108,110 provides a buffer for avoiding the distortion of the module 100 that might otherwise occur as a result of the differing thermal expansion characteristics of the piezoelectric material and the support member. In this preferred embodiment, this is particularly important due to the compactness of the droplet ejection unit, as described in more detail below.

A row of parallel fluid channels 112 are formed in the piezoelectric layers 104, 106. For example, the fluid channels may be provided by grooves formed in the piezoelectric wafers using a narrow dicing blade. As indicated by arrows 114 and 116 in FIG. 2, the piezoelectric wafers are poled in opposite directions. As the wafers 104 and 106 are oppositely poled, the walls 118 of the channels serve as wall actuators of the so called "chevron" type, such as are the subject of European Patents No. 0277703 and No. 0278590, the disclosures of which are incorporated herein by reference. These actuators are known to be advantageous because they require a lower actuating voltage to establish the same pressure in the fluid channels during operation.

After forming the channels 112, the wafers are diced to form a module as shown in FIG. 1. In the preferred embodiment, the module includes 64 fluid channels, each with a length of 2 mm (approximately equal to 2× the acoustic length of ink in the channel during operation).

Figure 3:
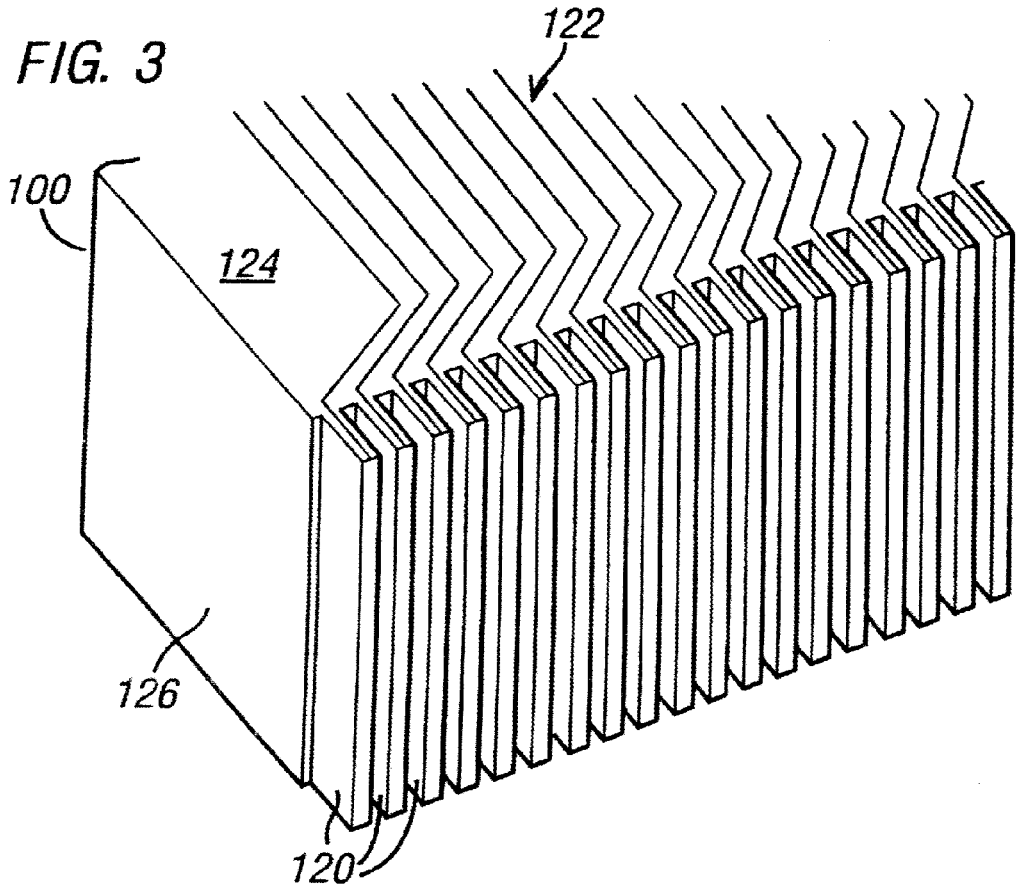
FIG. 3 represents a perspective view of the module of FIG. 1 with electrodes and interconnection tracks formed thereon.

With reference to FIG. 3, metallized plating is deposited on the opposing faces of the ink channels 112, where it extends the full height of the channel walls 118 providing actuation electrodes 120 to which a passivation coating may be applied. In one technique for forming the electrodes, a seed layer, such as Nd:YAG, is sputtered over the module 100 and into the channels 112.

An interconnect pattern 122 is formed one or both sides 124 of the module 100, for example, by using the well-know laser ablation, photoresist or masking technique. Formation of the interconnect pattern on both sides 124 of the module can halve the density of the tracks of the interconnect pattern, thereby facilitating formation of the interconnect pattern. With the seed layer having been defined, the layer is plated to form the electrode tracks, for example, using an electroless nickel plating process. The tops of the walls 118 separating the channels 112 are kept free of plating metal so that the track and the electrode for each channel are electrically isolated from other channels.

Figure 4:
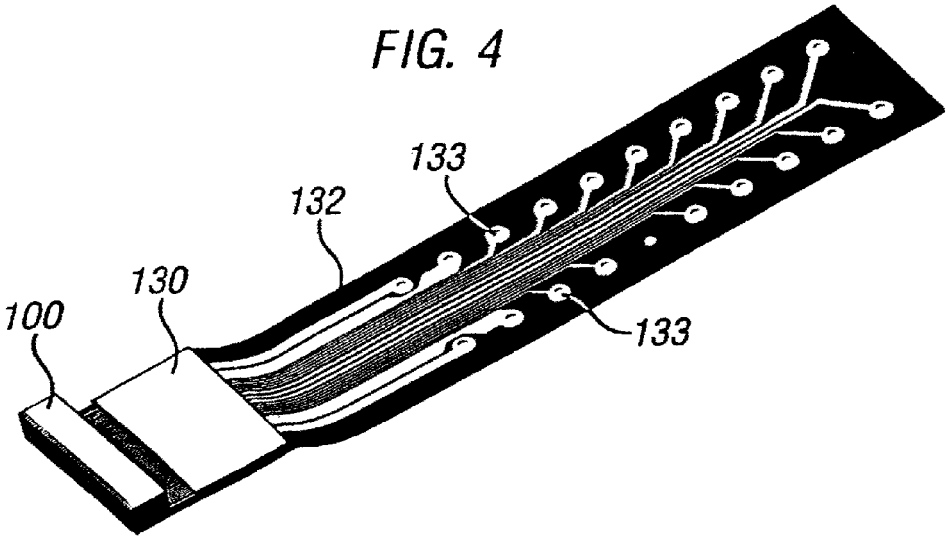
FIG. 4 represents a perspective view of a single drive circuit connected to a droplet ejection module.
Figure 5:
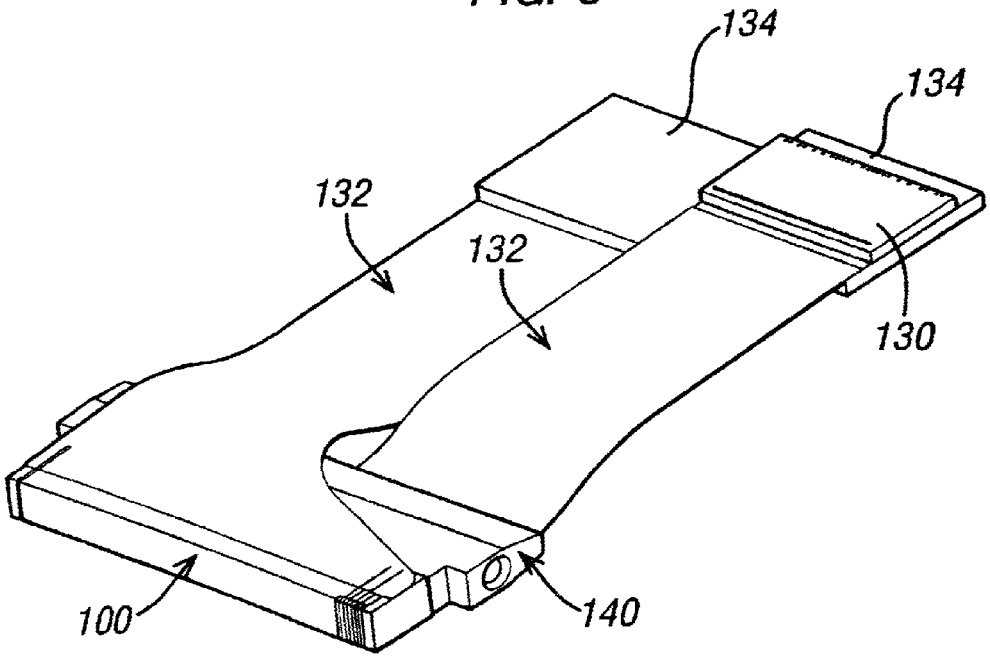
FIG. 5 represents a perspective view of two drive circuits connected to a droplet ejection module.

With reference to FIGS. 4 and 5, each module is connected to at least one associated drive circuitry (integrated circuit ("chip") 130) by means, for example, of a flexible circuit 132. In the arrangement shown in FIG. 4, the module 100 has interconnection tracks formed on one side only, and thus only one chip 130 is required to drive the actuators 118. In the FIG. 5 arrangement, the module 100 has interconnection tracks formed on both sides of the module, with two chips 130 driving the actuators 118. Via holes 133 may be formed in the flexible circuit 132 to enable the chip to be connected to other components of the drive circuitry, such as resistors, capacitors or the like.

As shown in FIG. 5, the module 100 is attached to a support member 140.

The drive circuitry 130 may be connected to the module prior to its attachment to the support member, thereby enabling the module to be tested prior to attachment on the support member, or may be connected to the module when it is already attached to the support member 140.

As described in more detail below, in the embodiment shown in FIG. 5 the support member 140 is made of a material having good thermal conduction properties. Of such materials, aluminium is particularly preferred on the grounds that it can be easily and cheaply formed by extrusion. In order to reduce the size of the printhead in the direction of paper feed, the support member 140 has a thickness in the direction of the length of the fluid channels substantially equal to the length of the fluid channels.

Figure 6:
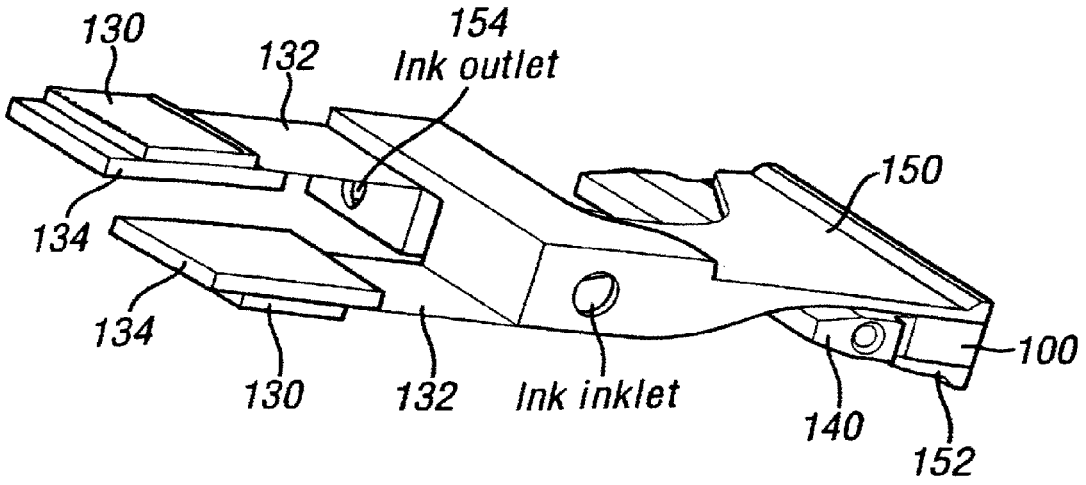
FIG. 6 represents a perspective view of a first embodiment of an arrangement of a droplet ejection module with fluid conduits attached thereto for the supply of fluid to the module.

FIG. 6 illustrates the connection of conduits for conveying ink to and from the module shown in FIG. 5 in a first embodiment of a droplet deposition apparatus. The conduits comprise a first ink supply manifold 150 for supplying ink to the module 100 and a second ink supply manifold 152 for conveying ink away from the manifold 152. In the arrangement shown in FIG. 6, the manifolds 150,152 are configured so as to convey ink to and from all of the ink channels of the module 100. The manifolds may be formed from any suitable material, such as plastics material.

Figure 7:
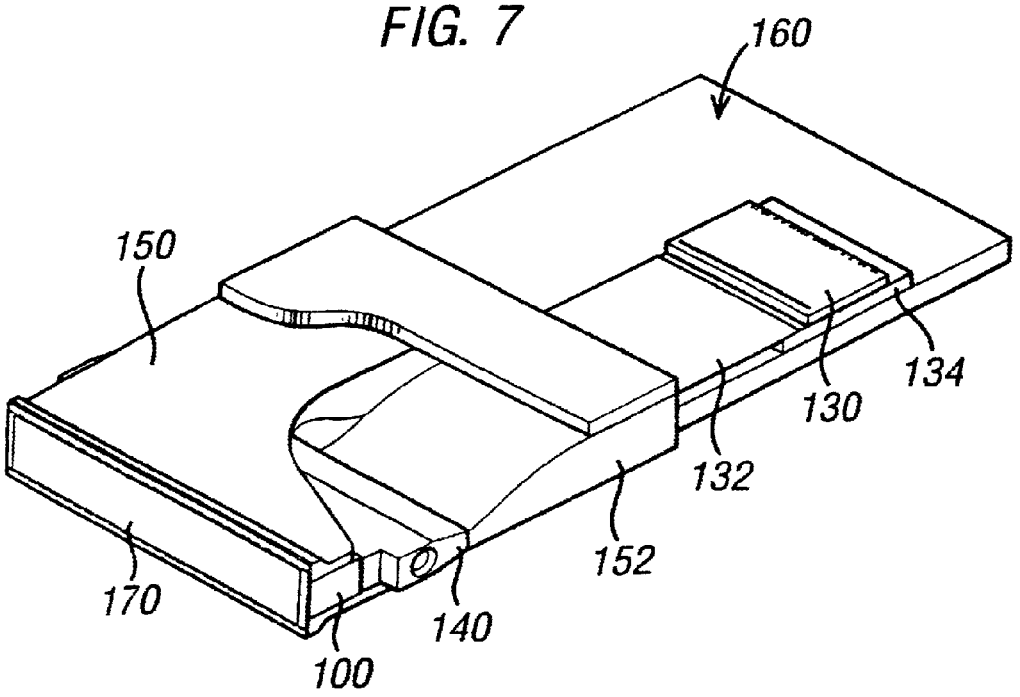
FIG. 7 represents a perspective view of the arrangement shown in FIG. 6 with a heat sink attached thereto.

With reference to FIG. 7, a heatsink 160 is connected to the ink outlet 154 of the second manifold 152. The heatsink is hollow, and is used to convey ink away from the second manifold 152 to an ink reservoir (not shown). As shown in FIG. 7, the drive circuits 130 are mounted in substantial thermal contact with the heatsink 160 so as to allow a substantial amount of the heat generated by the circuits during their operation to transfer via the heatsink 160 to the ink. To this end, the heat sink 160 is also formed from material having good thermal conduction properties, such as aluminium. Thermally conductive pads 134, or adhesive, may be optionally employed to reduce resistance to heat transfer between circuits 130 and the heatsink 160.

A nozzle plate 170 is bonded to the uppermost surface of the module 100.

The nozzle plate 170 consists of a strip of polymer such as polyimide, for example Ube Industries polyimide UPILEX R or S, coated with a non-wetting coating as provided in U.S. Pat. No. 5,010,356 (EP-B-0367438). The nozzle plate is bonded by application of a thin layer of glue, allowing the glue to form an adhesive bond between the nozzle plate 170 and the walls 118 then allowing the glue to cure. A row of nozzles, one for each ink channel 112, is formed in the nozzle plate, for example by UV excimer laser ablation, the row of nozzles extending in a direction orthogonal to the length of the ink channels 112 so that the actuators are so called "side shooter" actuators.

Figure 8:
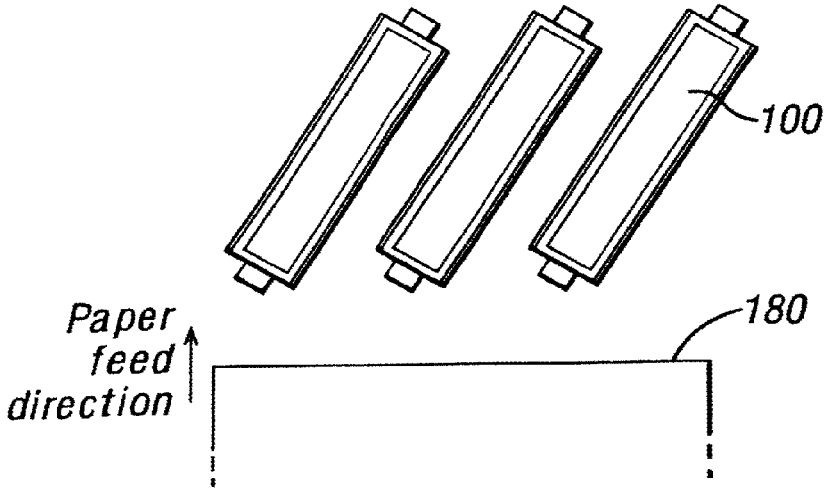
FIG. 8 represents a first array of arrangements shown in FIG. 7 in a printhead.
Figure 9:
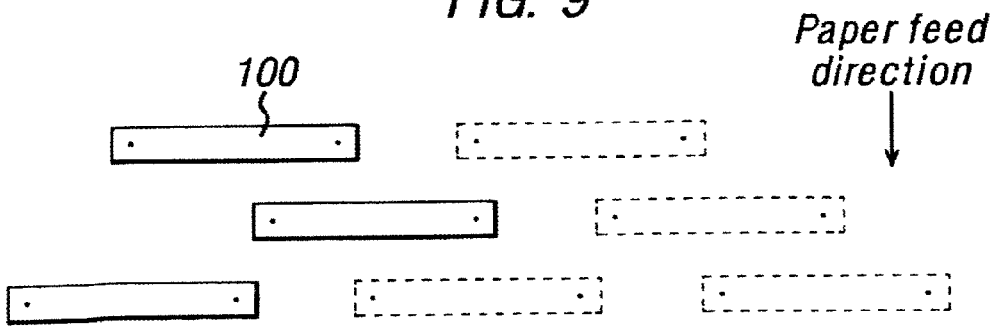
FIG. 9 represents a second array of arrangements shown in FIG. 7 in a printhead.
Figure 10:
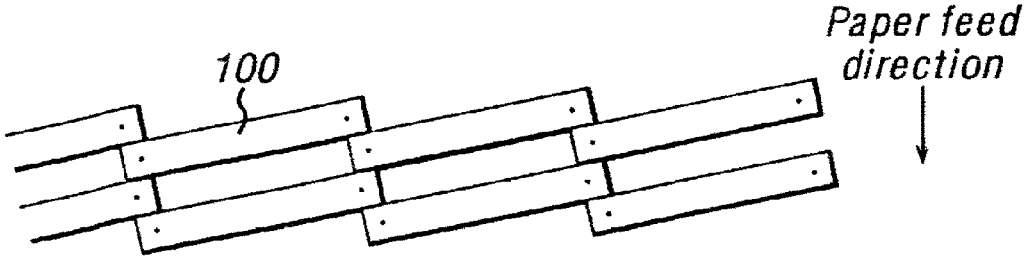
FIG. 10 represents a third array of arrangements shown in FIG. 7 in a printhead.

The module 100, when supplied with ink and operated with suitable voltage signals via the tracks 124 may be traversed either normally or at a suitable angle to the direction of motion across a paper printing surface to deposit ink on the printing surface. Alternatively, an array of independent modules 100 may be provided. The array layout may take any suitable form. For example, as shown in FIG. 8, three 180 dpi resolution modules may be angled to the direction of feed of a printing surface 180 to form a 360 dpi resolution array, whilst FIG. 9 shows "3-tier interleaved" array of modules and FIG. 10 shows a "2-row interleaved" array of modules 100 for providing the required printhead resolution.

Such a modular array eliminates the need to serially butt together a plurality of modules at facing end surfaces to provide a printhead having the required droplet density. Nonetheless, such modules may be butted together to form a pagewide array of modules.

A second embodiment of droplet deposition apparatus comprising such an arrangement of modules will now be described with reference to FIGS. 11 to 13.

Figure 11:
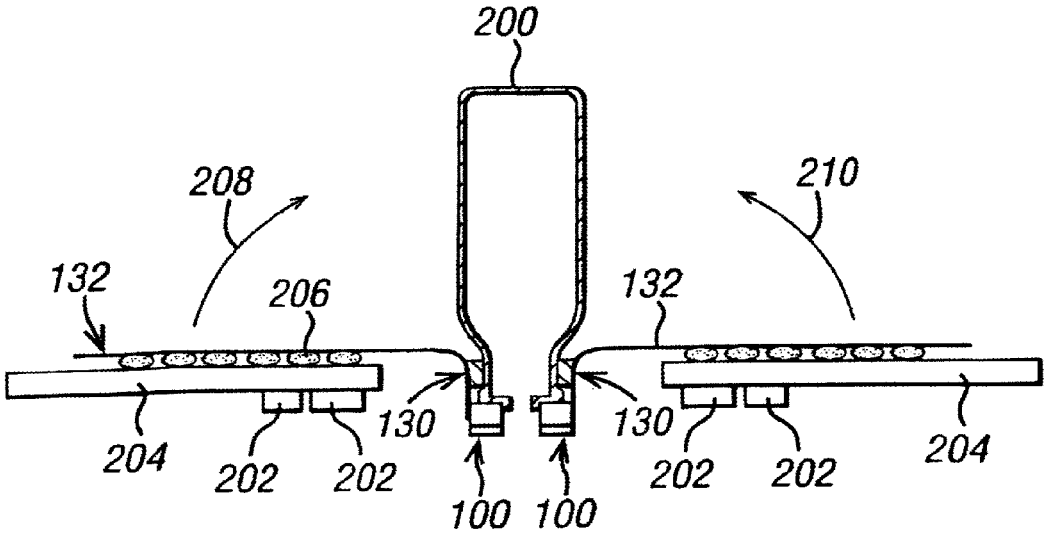
FIG. 11 represents a side view of a second embodiment of an arrangement of a plurality of droplet ejection modules attached to a support member.

With reference first to FIG. 11, this embodiment comprises a plurality of modules 100, for example, as shown in FIG. 4 with drive circuitry attached to one side 124 of the module 100. Each module is mounted on the end of an arm of a substantially U-shaped pagewide support member 200. On each arm, the modules are serially butted together at the edges 126 of the modules 100, as shown in FIG. 1, such that there is a single row of fluid channels extending orthogonal to the longitudinal axis, or length, of each of the ink channels 112. The modules may be butted together using glue bond material, and aligned using any suitable alignment technique. Each array of butted modules provides a 180 dpi resolution, and therefore the combination of two interleaved arrays formed on respective arms of the support member 200 provides a printhead having a 360 dpi resolution.

Similar to the first embodiment, the chips 130 are mounted on the outer surface of the support member 200 so as to lie in substantial thermal contact with the support member 200. As shown in FIG. 11, further components 202 of the drive circuitry may be connected to the chip 130 via a printed circuit board 204 mounted on the track using solder bumps 206. Following mounting of the chips on the support member 200, each track 132 is folded in the direction indicated by arrows 208,210 in FIG. 11 so that the printed circuit boards 204 also come into thermal contact with the support member 200.

As described in more detail below, the U-shaped support member 200 acts as an outlet manifold for conveying fluid away from the droplet ejection units. The drive circuits 130 for the modules 100 are mounted in substantial thermal contact with that part of structure 200 acting as the outlet manifold so as to allow a substantial amount of the heat generated by the circuits during their operation to transfer via the conduit structure to the ink. To this end, the structure 200 is made of a material having good thermal conduction properties, such as aluminium.

Figure 12:
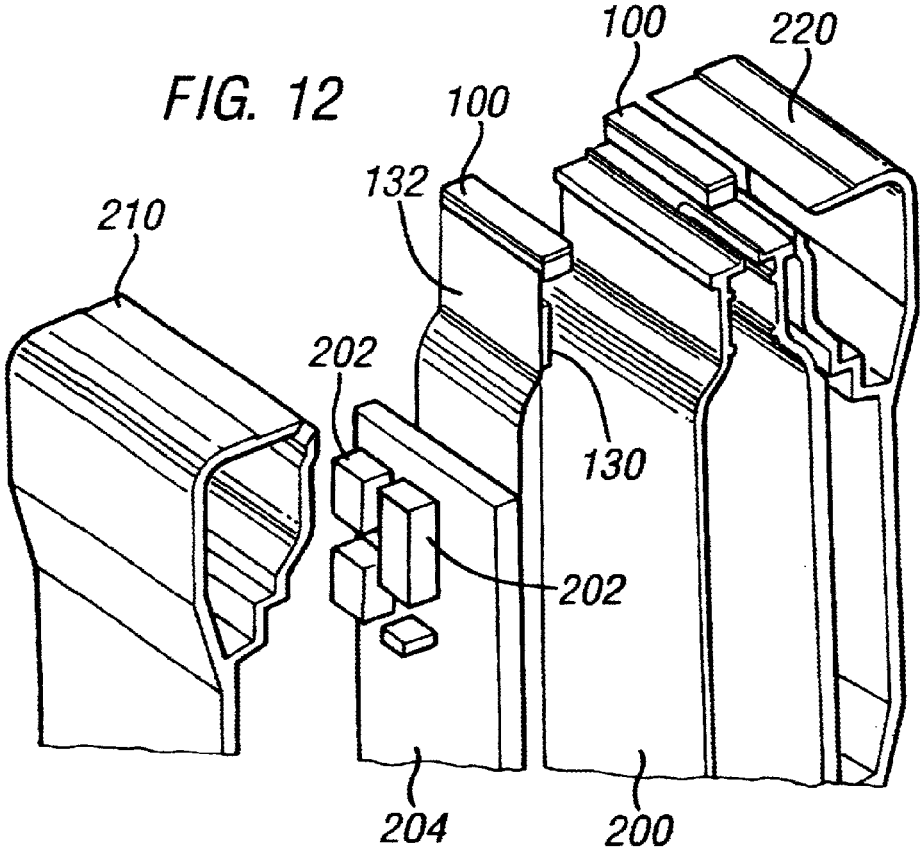
FIG. 12 represents an exploded perspective view of the embodiment shown in FIG. 11 with fluid conduits for the supply of fluid to the modules.

With reference to FIG. 12, ink inlet manifolds 210,220 extending substantially the entire length of the support member 200 are provided for supplying ink to each of the modules attached to respective arms of the support member (only one module 100 is shown in FIG. 11 for clarity purposes only). The inlet manifolds 210,220 may be formed from extruded plastics or metallic materials. As will be appreciated from FIG. 12, the inlet manifolds also act to provide external covers to protect the components 202 of the drive circuitry for the modules 100. Endcaps (not shown) are fitted to the ends of the support member 200 and inlet manifolds 210,220 to form seals to complete the inlet and outlet manifolds and to enclose the drive circuitry.

Figure 13:
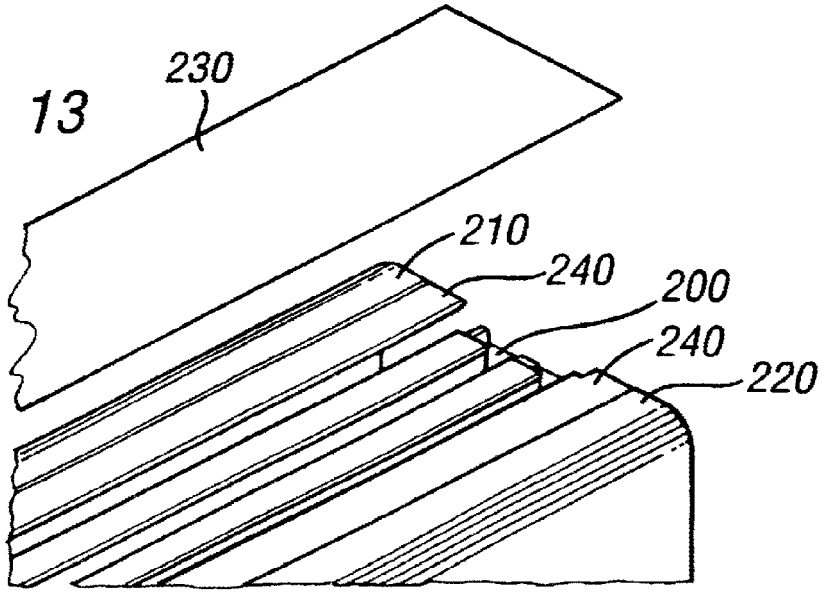
FIG. 13 represents a perspective view of the attachment of a nozzle plate to the arrangement shown in FIG. 12.

With reference to FIG. 13, similar to the first embodiment a nozzle plate 230 is attached to the tops of the actuator walls 118 and two rows of nozzles formed in the nozzle plate, one row for each of the rows of ink channels. As shown in FIG. 13, the nozzle plate 230 is additionally supported on each side by portions 240 of the ink inlet manifolds 210,220. The nozzle plate 230 may be further supported by a support blanking actuator component (not shown) provided at each end of each of the arrays of modules.

An example of another arrangement of butted modules will now be described with reference to FIGS. 14 to 18, in which the U-shaped support member 200 is replaced by a planar, parallel-sided support member 300.

Figure 14:
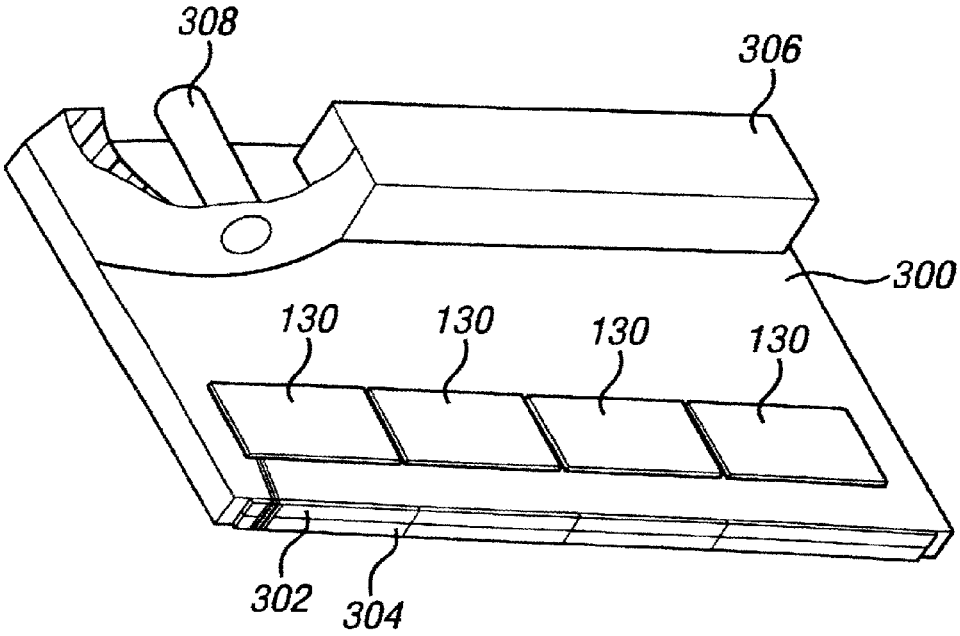
FIG. 14 represents a perspective view of a third embodiment of an arrangement of a plurality of droplet ejection modules attached to a support member.
Figure 15:
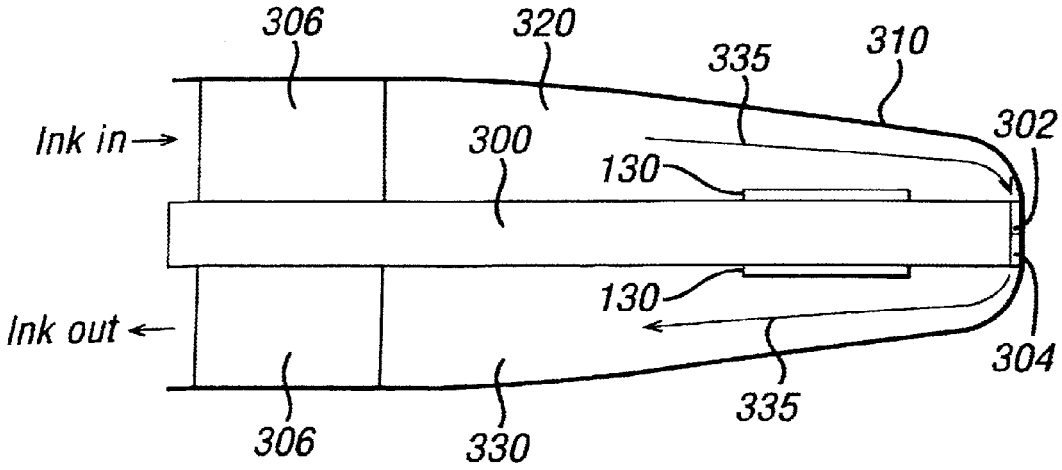
FIG. 15 represents a side view of the arrangement shown in FIG. 14 with a cover member attached thereto to define fluid conduits for the supply of fluid to the modules.

With reference to FIGS. 14 and 15, two rows 302,304 of modules are attached to the support member 300. Whilst FIG. 14 shows two rows of four butted modules, any number of modules may be butted together, although it is preferred that the length of each row is substantially equal to the length of a page (typically 12.6 inches (32 cm) for the American "Foolscap" standard).

The support member 300 is preferably formed from ceramic material, such as alumina. This enables the base wafer 102 of the modules 100 to be omitted, thereby reducing further the number of components of the printhead. If so, the first layer 104 of each module is attached directly to the support member 300, for example, using a resilient glue bond. Similar to the module shown in FIG. 1, a second piezoelectric layer 106 is attached to the first piezoelectric layer 104.

Similar to the arrangement shown in FIG. 1, ink channels 112 are formed in the piezoelectric layers 104,106 by, for example, machining and electrodes and interconnect tracks are formed in the channels 112 and on both sides of the support member 300 (only a small number of ink channels and interconnects are shown in FIG. 14 for clarity purposes only). The ink channels are formed such that each ink channel of one row 302 is c-axial with an ink channel of the other row 304.

Drive circuitry, or chips 130, are attached directly to the sides of the support member 300 for supplying electrical pulses to the interconnect tracks to actuate the walls 118 of the channels 112. As the support member is formed from alumina, for example, having a relatively low CTE, this substantially prevents heat generated in the chips 130 from being transferred through the support member to the actuators 118. The drive circuitry may be coated, for example, with parylene.

Housings 306 for housing electrical connections to the chips 130 are also attached to each side of the support member 300. The housings 306 may be conveniently formed from injection molded plastics material. In addition, a fluid inlet/outlet 308 is also attached to each side of the support member 300.

The fluid inlet/outlet may be integral with the adjacent housing 306, and may include a filter, especially at the inlet side, for filtering ink to be supplied to the modules.

Figure 16:
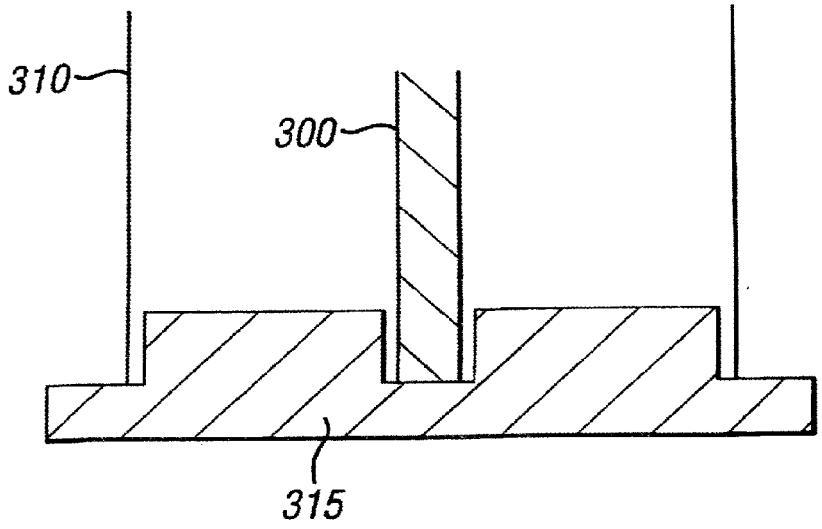
FIG. 16 represents a side view of a portion of the arrangement shown in FIG. 15 attached to a base.

A cover 310 extends over the entire length and to both sides of the support member 300. As shown in FIG. 16, the base of the support member 300 and both ends of the cover 310 are attached to a base plate 315. The cover is preferably formed from a material that is thermally matched to the material of the piezoelectric wafers 104,106. Molybdenum, which has high strength and thermal conductivity in addition to being thermally matched to PZT, has been found to be a particularly suitable material for the cover.

The cover 310 defines with the support member an ink inlet conduit 320 and an ink outlet conduit 330 for conveying ink to and from all of the channels of the two rows 302,304 of modules as indicated by arrows 335 in FIG. 15.

Endcaps (not shown) are fitted to the ends of the support member 300 and cover 310 to form seals to complete, with the housings 306, the inlet and outlet conduits and to enclose the electronics.

The c-axial arrangement of the ink channels of the two rows enables ink to flow from the ink inlet conduit 320 into an ink channel of row 302, from that ink channel directly into an ink channel of the other row 304, and from that ink channel to the ink outlet conduit 330. With the arrangement of chips 130 on the sides of the support member 300, heat generated at the surfaces of the chips in thermal contact with the ink carried by the conduits 320,330 is substantially transferred to the ink.

Figure 17:
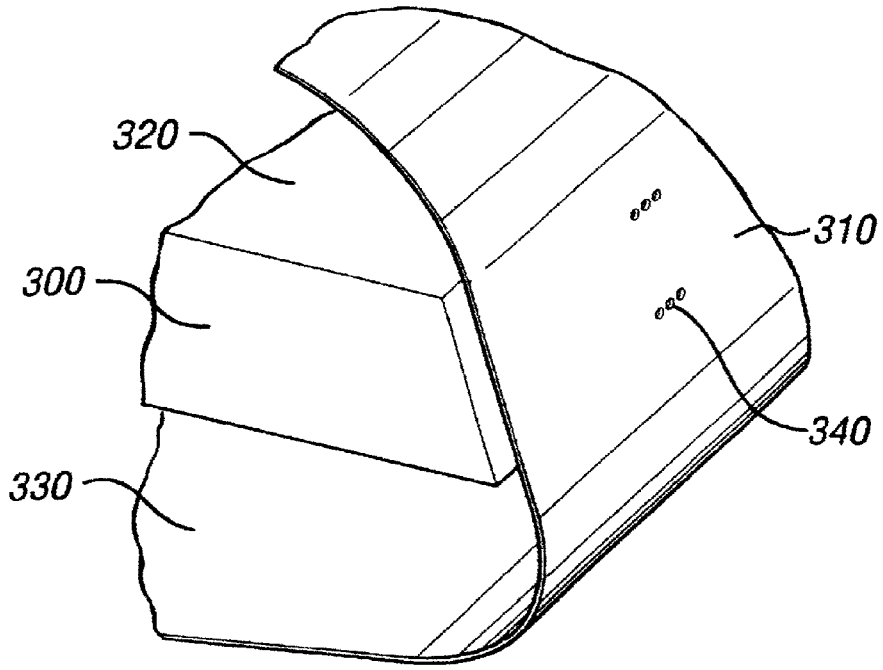
FIG. 17 represents a perspective view of the arrangement shown in FIG. 15 with apertures formed in the cover for the ejection of ink from ink channels.
Figure 18:
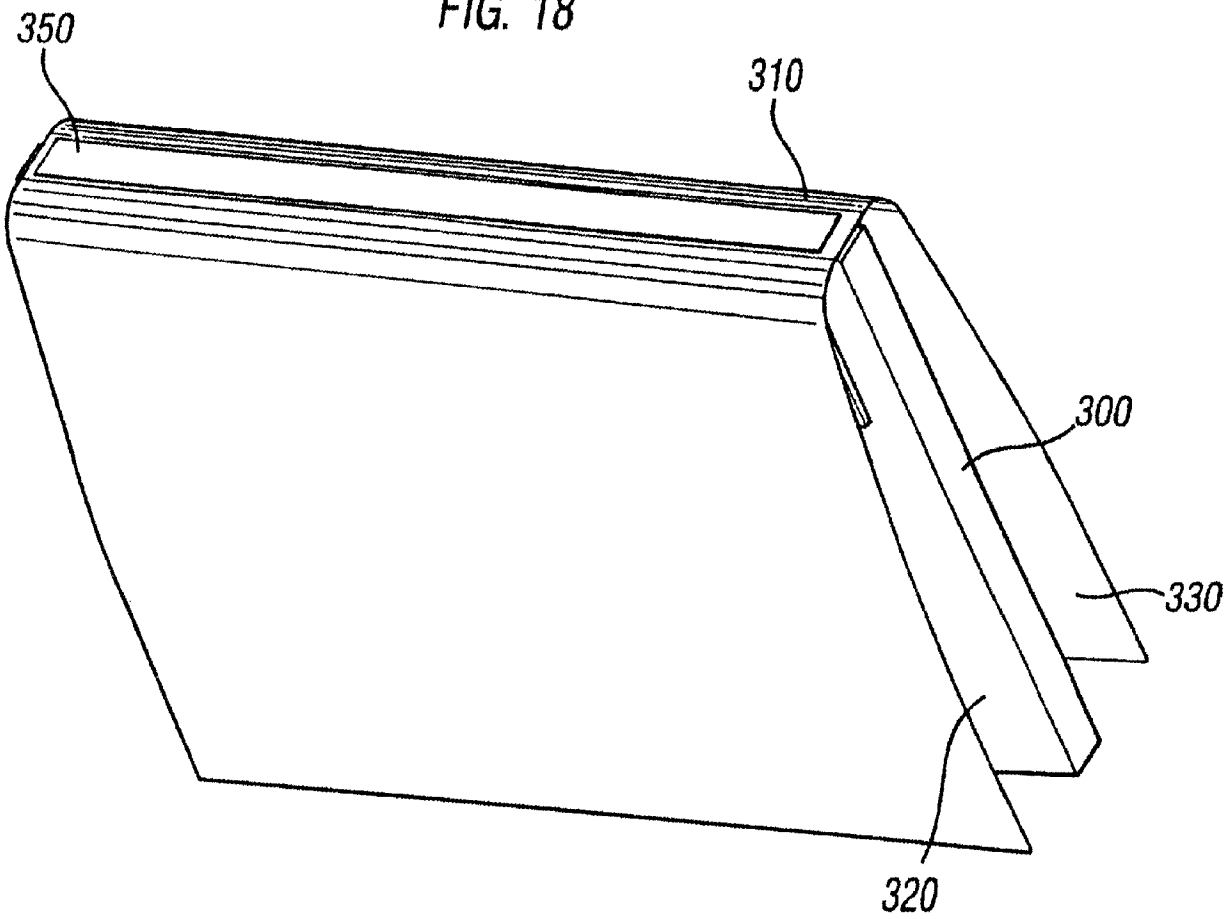
FIG. 18 represents a perspective view of the arrangement shown in FIG. 15 with a nozzle plate attached to the cover.

As shown in FIG. 17, apertures 340 are formed in the cover 310 to enable ink to be ejected from the modules through the cover 310. The apertures 340 may be formed by any suitable method, for example, UV excimer laser ablation, and may serve as nozzles for the droplet ejection modules. alternatively, as shown in FIG. 18, a nozzle plate 350 may be attached to the cover, with nozzles being formed in the nozzle plate 350 such that the nozzles are in fluid communication with the ink channels 112 via the apertures 340.

As the nozzle plate 350 is supported by the cover 310, this enables the thickness of the nozzle plate to be reduced. Alternatively, the nozzle plate 350 may be attached directly to the modules, with the cover 310 extending over the nozzle plate with apertures 340 aligned with the nozzles formed in the nozzle plate.

Operation of the third embodiment will now be described.

In its simplest form, when one pair of actuator walls 118 one row, say 304 are required to eject a droplet of fluid from the ink channel 112 between the actuator walls 118, the walls of the ink channel of row 304 which is c-axial with that ink channel may be driven to replicate the acoustics of an ink manifold disposed at the end of that ink channel. In the case of "grey scale" printing, a number of droplets may be ejected from the ink channel of row 302, followed by a similar number of droplets from the c-axial ink channel of row 304. Alternatively, in order to increase the printing speed, a droplet may be fired from each channel in turn. For example, ink can be drawn into one channel followed by (at some specific frequency) by a similar event in the other co-axial channel. This would provide a constant stable acoustic effect within each channel.

Figure 19:
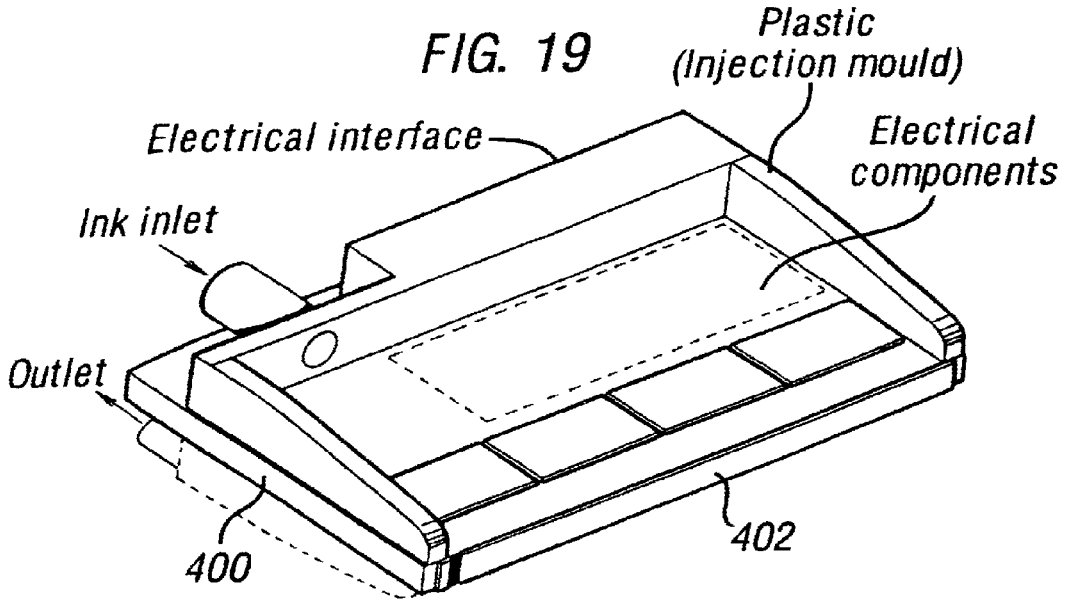
FIG. 19 represents a perspective view of a fourth embodiment of an arrangement of a plurality of droplet ejection modules attached to a support member.

Whilst the embodiment shown with reference to FIGS. 14 to 18 includes two rows of modules, a single row of ink modules may alternatively be used. Such an arrangement is shown in FIG. 19. In this embodiment, a single row 402 of modules is attached to the support member 400. Whilst FIG. 19 shows four butted modules, any number of modules may be butted together, although it is preferred that the length of each row is substantially equal to the length of a page (typically 12.6 inches (32 cm) for the American "Foolscap" standard).

With such an arrangement, the width of the support member may be reduced to substantially the length of a single ink channel 112, and chips 130 connected to one side only of the support member. However, there will, of course, be a reduction in the resolution of the printhead (from 360 dpi to 180 dpi). Resolution may be increased by providing two such arrangements "back to back" with a common ink inlet provided between the rows of modules.

Figure 20:
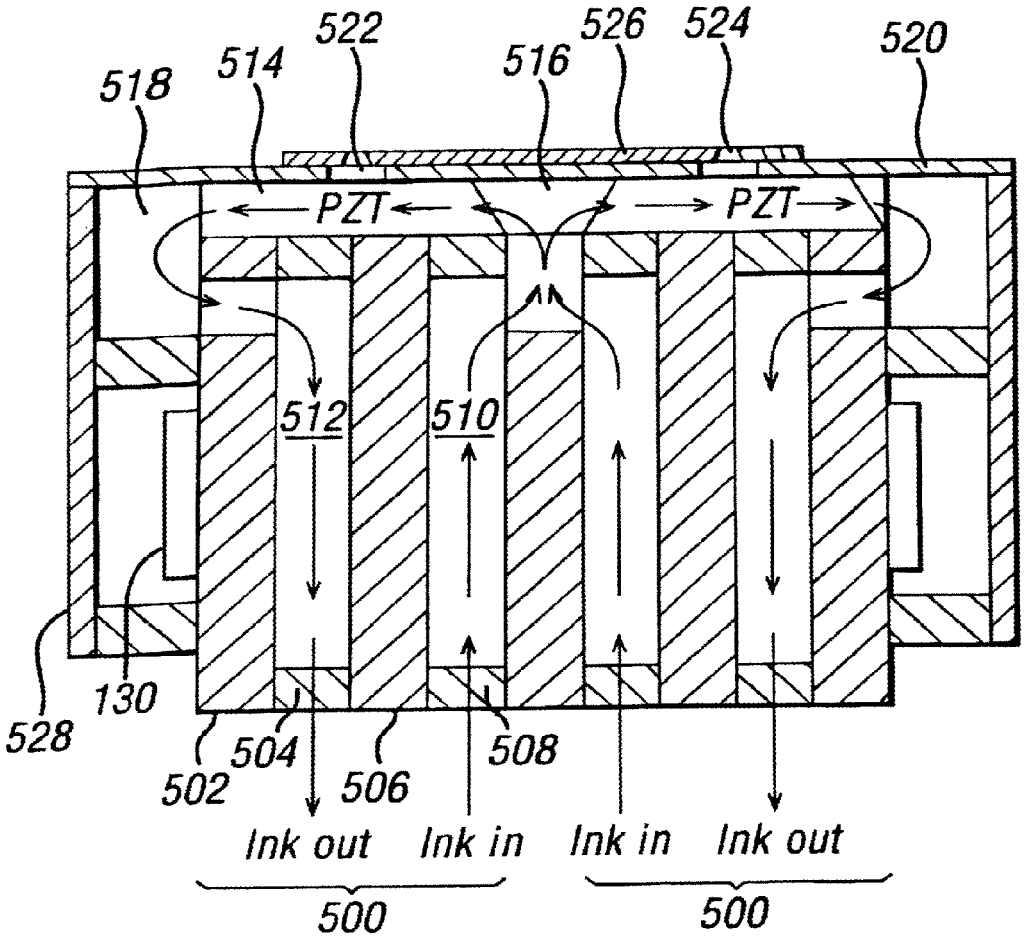
FIG. 20 represents a side view of a fifth embodiment of an arrangement of droplet ejection modules with fluid conduits for the supply of fluid to the modules.

FIG. 20 shows a simplified cross-sectional view of a fifth embodiment of an arrangement of droplet ejection modules with fluid conduits for the supply of fluid to the modules. In this embodiment, the support structure 500 comprises a laminated structure of multiple sheets of alumina. In the embodiment shown in FIG. 20, there are 4 laminated sheets 502,504, 506,508 of alumina, although any number of sheets may be used.

The sheets of the support structure 500 are machined or otherwise shaped to define, in the laminated structure, channels 510,512 for conveying ink towards and away from one or more modules 514 attached to the support structure 500. As shown in FIG. 20, channel 510 conveys ink to conduit 516 extending along one side of module 514 for supplying ink to the module 514, and channel 512 conveys ink away from conduit 518 extending along the other side of module 514.

Conduit 518 is defined by a cover member 520 attached to the top of the module 514 and having apertures 522 such that nozzles 524 of nozzle plate 526 are in fluid communication with the ink channels of the module via the apertures 522, and by end cap 528 attached to the side of the support structure. Whilst conduit 516 may be defined in a similar manner, in the arrangement shown in FIG. 20 this conduit is common to two support structures 500, and so alternatively this conduit is defined by the cover member 520 and alumina plate 530 to which the two support structures are attached.

Similar to the previous embodiments, drive circuitry 130 is attached directly to the sides of the support member 500 for supplying electrical pulses to the interconnect tracks to actuate the walls of the channels of the module. As the support member is formed from alumina, for example, having a relatively low CTE, this substantially prevents heat generated in the chips 130 from being transferred through the support member to the actuators. In this embodiment, however, the drive circuitry is not in fluid communication with the ink conveyed to and from the module, but is instead located in a housing formed in the end cap 528.

Figure 21:
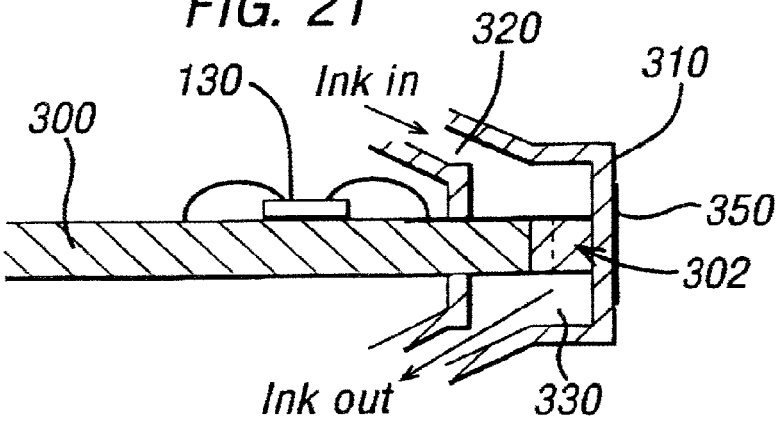
FIGS. 21 to 25 represent cross-sectional views of further embodiments of arrangements of droplet ejection modules with fluid conduits attached thereto.

FIG. 21 illustrates a cross-sectional view of a further embodiment of an arrangement of droplet ejection modules with fluid conduits for the supply of fluid to the modules. This embodiment is similar to that of the fifth embodiment, in that a cover extends over and to the sides of the support member 300 to define a first conduit 320 and a second conduit 330 both extending along a row of droplet ejection channels and to the sides of the support member 130. In this embodiment, a single row of modules 302 is mounted on the end of a support member 300, and the first and second conduits 320 and 330 are spaced from the chips 130 mounted on the side of the support member 300 so as to avoid the need to passivate the surfaces of the chips 130. In order to dissipate heat generated by the chips 130 during operation, the support member 300 is formed from thermally conducting material in order to conduct heat generated by the chips 130 to the fluid conveyed by the conduits 320 and 330.

Figure 22:
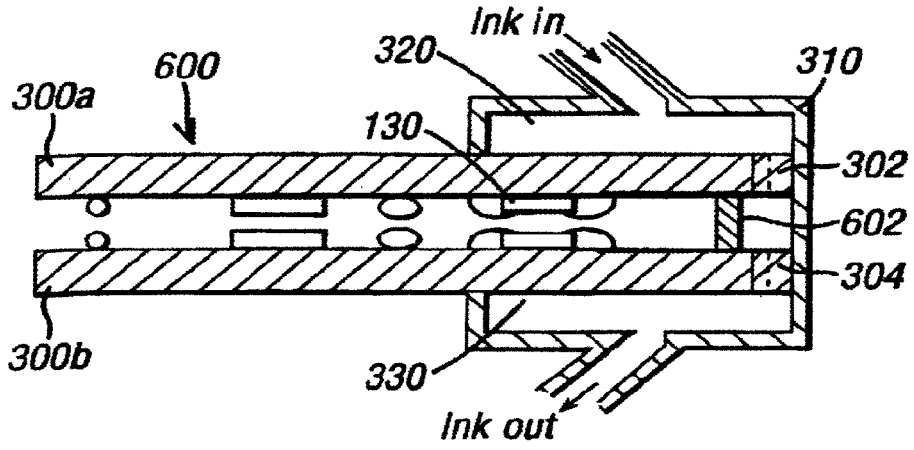

In the embodiment shown in FIG. 22. two rows 302,304 of ejection units are provided on a substantially U-shaped, or H-shaped, support member 600 comprising a pair of support members 300*a*, 300*b* linked by a bridging wall 602. Chips 130 and associated circuitry 602 are mounted on the facing surfaces of the support members 300*a*, 300*b*, interconnect tracks 600 being formed on these surfaces for supplying actuating electrical signals to the walls of the ejection units. Fluid is conveyed to and away from the ejection units by conduits 320,330 defined by cover member 310 and the support member 600, the bridging wall 602 acting to direct fluid from the first row 302 to the second row 304. Heat generated in the chips 130 during operation is conducted by the support members 300*a*, 300*b* into fluid carried by the conduits 320, 330.

Figure 23:
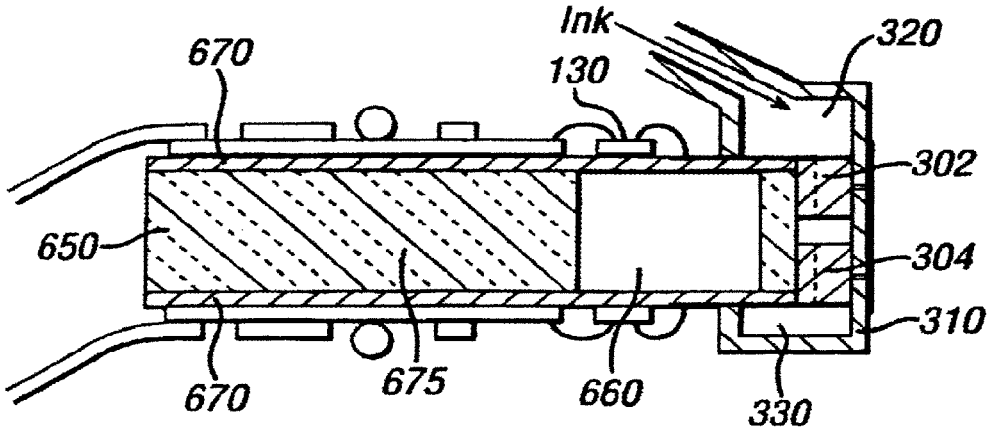

FIG. 23 illustrates an embodiment in which heat generated during operation both by the chips 130 mounted on either side of the support member 650 and by the rows 302,304 of ejection units mounted on the support member is transferred to a coolant fluid, such as water, conveyed by a conduit 660 passing through the support member 650. The walls 670 of the support member are preferably suitably thin so that heat is conducted to the coolant fluid as quickly as possible. To improve conduction, the walls 670 may be formed from metallic material. The body 675 of the support member may be formed from ceramic material.

Figure 24:
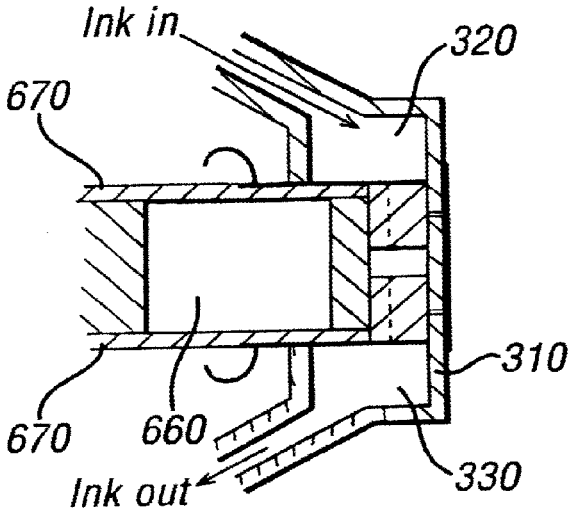

In the embodiment shown in FIG. 23, there is no recirculation of droplet fluid, in that the conduit 330 simply receives fluid from the ejection units 304 and does not convey fluid back to a reservoir for re-use. FIG. 24 illustrates a modification of this embodiment, in which conduit 330 is configured to convey fluid back to a reservoir for re-use.

Figure 25:
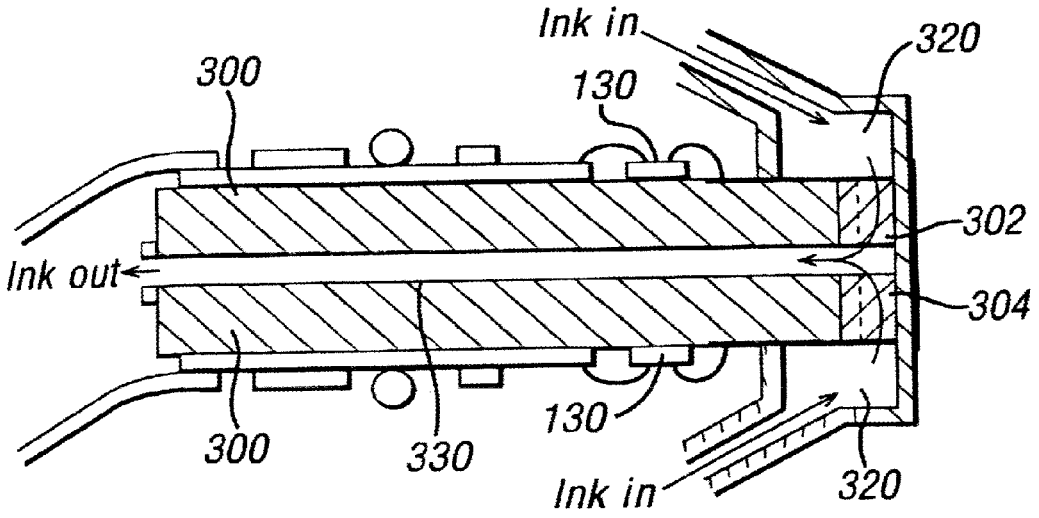

FIG. 25 illustrates an embodiment in which each row 302, 304 of ejection units is mounted on a respective support member 300. Fluid is conveyed to each row by a respective conduit 320 extending along that row and to one side of the support member on which that row is mounted. Fluid is conveyed away from the rows by a mutual conduit 330 extending between the facing side walls of the two support members 300, heat generated by the chips 130 being transferred to fluid conveyed in the conduit 330. Providing two "inlet" conduits 320 can enable the printhead to be flushed effectively during production to remove dirt. A slow bleed of droplet fluids from one of the conduits 320 can be used to remove air bubbles during printing, whilst a larger flow could be induced during a pause in printing for maintenance purposes.

Each feature disclosed in this specification (which term includes the claims) and/or shown in the drawings may be incorporated in the invention independently of other disclosed and/or illustrated features.

The invention claimed is:

1. A droplet deposition apparatus comprising:

a first plurality of fluid channels disposed side by side in a first row extending in a first direction;

an actuator having a plurality of piezoelectric actuator elements;

drive circuitry for supplying actuating electrical signals to said actuator elements, each of said first plurality of fluid channels having a nozzle and each of said actuator elements being actuable to eject a droplet of fluid in a second direction, perpendicular to said first direction, from a respective one of said first plurality of fluid channels through the nozzle of said fluid channel; and two or more fluid conveying conduits comprising a first fluid conveying conduit for conveying droplet fluid to each of said first plurality of fluid channels and a second fluid conveying conduit for conveying droplet fluid away from each of said first plurality of fluid channels, said first and second fluid conveying conduits extending substantially the length of said first row in said first direction; and a support member having a mounting surface extending substantially in said first and second directions, said drive circuitry being mounted on said mounting surface;

wherein said first and second fluid conveying conduits are fluidically connected in series via said first plurality of fluid channels such that, during use, fluid may be conveyed from said first fluid conveying conduit, through said first plurality of fluid channels, past said nozzles, and into said second fluid conveying conduit.

2. The apparatus according to claim 1, wherein said support member is planar.

3. The apparatus according to claim 2, further comprising interconnect tracks provided at least in part on said mounting surface, said interconnect tracks electrically connecting said drive circuitry and said actuator.

4. The apparatus according to claim 1, wherein a third direction is normal to said mounting surface, said third direction being substantially orthogonal to said first and second directions.

5. The apparatus according to claim 1, further comprising a cover member providing said nozzles and extending in a plane perpendicular to said second direction.

6. The apparatus according to claim 5, wherein said cover member at least in part defines said first plurality of fluid channels.

7. The apparatus according to claim 5, wherein said support member and said cover member are arranged such that, viewed in said second direction, said cover member overlies said support member.

8. The apparatus according to claim 1, wherein said first fluid conveying conduit conveys said droplet fluid in substantially the opposite direction to said second fluid conveying conduit.

9. The apparatus according to claim 1, further comprising a second plurality of fluid channels disposed side by side in a second row extending parallel to said first row in said first direction, each of said second plurality of fluid channels having a nozzle;

wherein said one or more fluid conveying conduits further comprise a third fluid conveying conduit for conveying droplet fluid to each of said second plurality of fluid channels and a fourth fluid conveying conduit for conveying droplet fluid away from each of said second plurality of fluid channels, said third and fourth fluid conveying conduits extending substantially the length of said second row in said first direction wherein said third and fourth fluid conveying conduits are fluidically connected in series via said second plurality of fluid channels such that, during use, fluid is conveyed from said third fluid conveying conduit, through said second plurality of fluid channels, past the nozzles of said second plurality of fluid channels, and into said fourth fluid conveying conduit.

10. The apparatus according to claim 9, wherein each of said first and third fluid conveying conduits is located between said second and said fourth fluid conveying conduits.

11. The apparatus according to claim 9, with respect to a third direction orthogonal to said first and second directions, wherein said plurality of fluid conveying conduits are arranged so as to be ordered consecutively as: said second conduit, said first conduit, said third conduit, and said fourth conduit.

12. The apparatus according to claim 9, further comprising a cover member providing said nozzles and extending in a plane perpendicular to said second direction.

13. The apparatus according to claim 12, wherein said cover member at least in part defines said first plurality and said second plurality of fluid channels.

14. The apparatus according to claim 13, wherein said support member and said cover member are arranged such that, viewed in said second direction, said cover member overlies said support member.

15. The apparatus according to claim 9, further comprising:

a second actuator having a second plurality of piezoelectric actuator elements; and second drive circuitry for supplying actuating electrical signals to said second plurality of actuator elements, each of said second plurality of actuator elements being actuable to eject a droplet of fluid in said second direction from a respective one of said second plurality of fluid channels through the nozzle of said fluid channel.

16. The apparatus according to claim 15, further comprising a second support member having a second mounting surface extending substantially in said first and second directions, said second drive circuitry being mounted on said second mounting surface.

17. The apparatus according to claim 16, further comprising a cover member providing the nozzles of said first plurality and second plurality of fluid channels and extending in a plane perpendicular to said second direction, said cover member at least in part defining said first plurality and said second plurality of fluid channels;

wherein said support member and said cover member are arranged such that, viewed in said second direction, said cover member overlies said first and second support members.

18. The apparatus according to claim 9, wherein said third fluid conveying conduit conveys said droplet fluid in substantially the opposite direction to said fourth fluid conveying conduit.

19. The apparatus according to claim 1, wherein said droplet deposition apparatus is a drop-on-demand droplet deposition apparatus.

20. The apparatus according to claim 1, wherein said droplet deposition apparatus is an ink jet printhead.

* * * * *